US007455086B1

(12) United States Patent
Elze et al.

(10) Patent No.: US 7,455,086 B1
(45) Date of Patent: Nov. 25, 2008

(54) VALVE FOR SPEED FILLING A DUNNAGE BAG

(76) Inventors: Olaf D Elze, 284 La Quinta Ct., Walnut Creek, CA (US) 94598; Helmut R Elze, 827 Grosvenor Pl., Oakland, CA (US) 94610; Mark Joseph Caires, 5328 Villas Ct., Winston Salem, NC (US) 27103

( * ) Notice: Subject to any disclaimer, the term of this patent is extended or adjusted under 35 U.S.C. 154(b) by 0 days.

(21) Appl. No.: 11/042,585

(22) Filed: Jan. 25, 2005

(51) Int. Cl.
*B65B 1/04* (2006.01)

(52) U.S. Cl. ..... 141/388; 141/37; 141/382; 141/392; 222/523

(58) Field of Classification Search ..... 141/10, 141/37, 38, 67, 114, 382, 388, 392; 222/174, 222/522, 523
See application file for complete search history.

(56) References Cited

U.S. PATENT DOCUMENTS 6,283,340 B1 * 9/2001 Waldner ..... 222/530

* cited by examiner

*Primary Examiner*—Timothy L. Maust
(74) *Attorney, Agent, or Firm*—Robert Samuel Smith

(57) ABSTRACT

A nozzle for accelerating filling a container with gas up to a required gas pressure including a barrel having venturi openings in a side of said barrel and a sleeve that, in one position uncovers the tunnels and in another position, closes off the openings. In another version the nozzle further includes a pressure chamber, having a wall coupled to the sleeve. In a contracted position the sleeve is moved by the wall of the chamber to close off the tunnels. In another position of the wall where the chamber is in an expanded position the tunnels are so as to increase the rate of flow.

4 Claims, 3 Drawing Sheets

VALVE FOR SPEED FILLING A DUNNAGE BAG

FIELD OF THE INVENTION

This invention relates to methods for speed pumping gas into a chamber and particularly for speed filling containers for gas such as dunnage bags used for cushioning freight in transit.

BACKGROUND AND INFORMATION DISCLOSURE

Numerous items are available on the market that require inflation with a gas to moderate pressures (often air) The situation often require that many of these items must be filled so that the overall time required to fill them requires a substantial period of time.

Examples of such items include balloons, balls, and cushions, for stadium seats. The numbers of items to be filled can be hundreds or even thousands. The time required to fill these items becomes an important cost factor.

An important application of an air filled cushion in industry is the dunnage bags such as are used to cushion freight during transit.

These bags are typically about four to eight feet on a side and are ten to twenty inches thick. They are positioned between stacks of cargo, typically on pallets and carried on trucks, planes, or ships.

The demand for "streamlining" the dunnage bag industry has resulted in significant economizing and reliability not only in the construction of the bag but also in the tools and method for filling and emptying the bag.

A typical "dunage bag", is an inflatable bag made of paper and/or other synthetic material with an airtight liner. The bag is placed on a conveying vehicle between stacks of cargo to prevent the shifting of cargo during transportation. Each bag is placed in the space between the cargo and the walls of the container or between neighboring rows of pallets holding cargo and then inflated. The bags are typically inflated to a pressure of not more than 1½ to 2 pounds per square inch (psi). In some operations, the time required to empty the bags is so expensive that when the cargo arrives at its destination and prior to unloading, the bags are simply punctured and discarded. Destroying the bag avoids spending the time to empty air out of the bag after the destination is reached.

The remaining problem is to reduce the time required to inflate the bag in preparation for its journey.

In response to the demand for an improved dungnage bag system including shortening the operation time, a number of concepts have been disclosed.

U.S. Pat. No. 5,042,663 to Heinrick discloses joinable inflatable bladders for packaging.

U.S. Pat. No. 5,431,525 to Sansone et al discloses a dual air bladder air bag.

Other approaches to economizing the dunage bag system has included improved valves.

For example, U.S. Pat. No. 4,073,389 to Angarola et al discloses a housing engaging a spring loaded plug that permits one way entry of air into the bag. However, the valve tends to dysfunction and leak with aging of the spring.

U.S. Pat. No. 4,102,364 to Leslie et al discloses a system for rapid pressurizing the air inside the bag from a source of high pressure air.

U.S. Pat. Nos. 4,146,069 and 4,146,070 to Angarola et al discloses another system for rapid filling using a stream of pressurized air to aspirate ambient air into the bag.

U.S. Pat. No. 5,111,838 to Langston discloses a spring loaded valve member movable to open a passage and threaded opening to engage an air hose.

U.S. Pat. No. 5,806,572 discloses an apparatus for inflating a bag to a desired limit.

U.S. Pat. No. 6,053,222 discloses a gun that both inflates the bag when required and accelerates deflation of the bag when required.

None of the several versions of a valve for a dunage bag described in the cited art address the problem of how to reduce the time required to inflate the bag. Typical inflation systems are characterized by a constant high pressure so that air initially flows into the bag at a fast rate but flow slows down as the target pressure is reached.

SUMMARY OF THE INVENTION

It is an object of this invention to provide a system for filling a container with pressurized air where the rate of filling is controllable.

This object includes an ability to minimize the effect of the pressure in the bag slowing down the flow rate as the bag fills with gas.

This invention is directed toward a nozzle having an entry port connectable to a source of pressurized gas. The other end of the nozzle has an exit port configured to communicate with the container (bag) to be filled with gas. Venturi openings are provided in the side of the nozzle. Each venturi opening is a tunnel from the inside surface of the wall of the Noxell to the outside of the nozzle. The tunnel slants from inside the barrel backward away from the direction of the stream of gas passing through the tunnel.

When the nozzle is connected between the bag to be filled and the pressurized air source, gas flows through the nozzle at its greatest rate. The flow of air into the bag drags air through the tunnels thereby accelerating the rate of inflating the bag. When the pressure inside the bag approaches the pressure outside the bag, the flow through the tunnels will reverse direction. According to the invention, at this point, the tunnels are closed and airflow into the bag continues until the target pressure of about 1½ pounds per square inch is reached.

A sleeve fits slidably onto the nozzle. In one position where the sleeve on the nozzle does not cover the tunnels, air flows through the nozzle. When the user joins the exit end of the nozzle to to the entrance to the bag, pressurized air flows from the source, through the nozzle and into the bag. The flow of air through the nozzle "drags" additional air through the tunnels by virtue of the "venturi" effect. The rate of flow through the nozzle is increased appreciably.

In use, as the bag fills with air, the pressure of air in the bag approaches the pressure of the pressurized air source and the rate of flow slows down until a condition is reached where air flows in a reverse direction through the tunnels out of the interior of the nozzle. When the flow of air through the tunnels reverses direction, the sleeve is slid into a position where the sleeve covers (closes) the tunnels. Closing the tunnels restores the rate of flow to where the air pressure inside the bag equals a required value.

In one embodiment of the invention, the act of sliding the sleeve over the tunnels is performed manually by the operator "feeling" when airflow through the tunnels reverses direction In another embodiment, when the pressure in the nozzle reaches a critical value, a piston forces the sleeve to slide on the barrel to a position where flow through the venturi tunnels is blocked.

DESCRIPTION OF BEST MODE

Figure 1A:
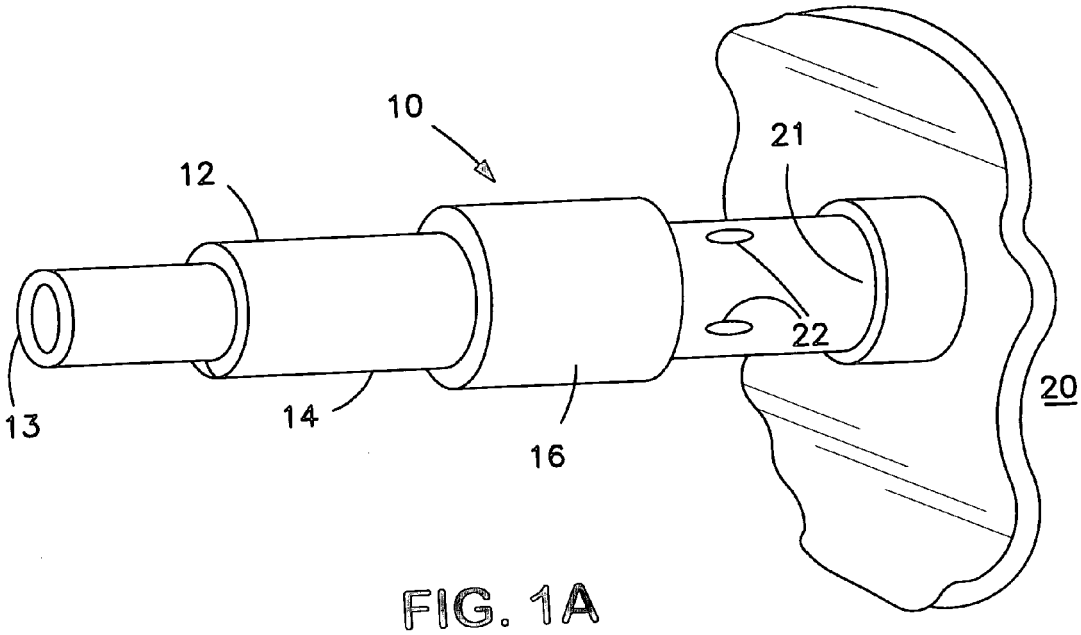
FIG. 1A is an assembly view of one version of the invention showing in FIG. 1A a sleeve on a barrel positioned for fast rate of air flow through the nozzle at low bag pressure.
Figure 1B:
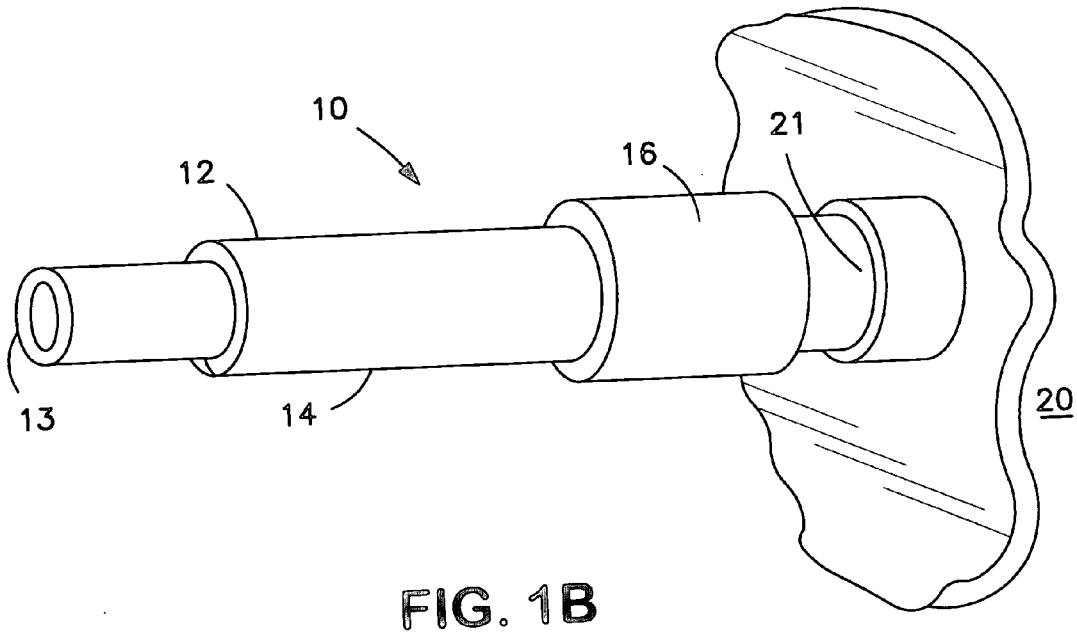
FIG. 1B is an assembly view identical to FIG. 1 except that the sleeve has been slid over tunnels in the barrel achieve greater pressure in the bag. In the final stages of inflating the bag.
Figure 2A:
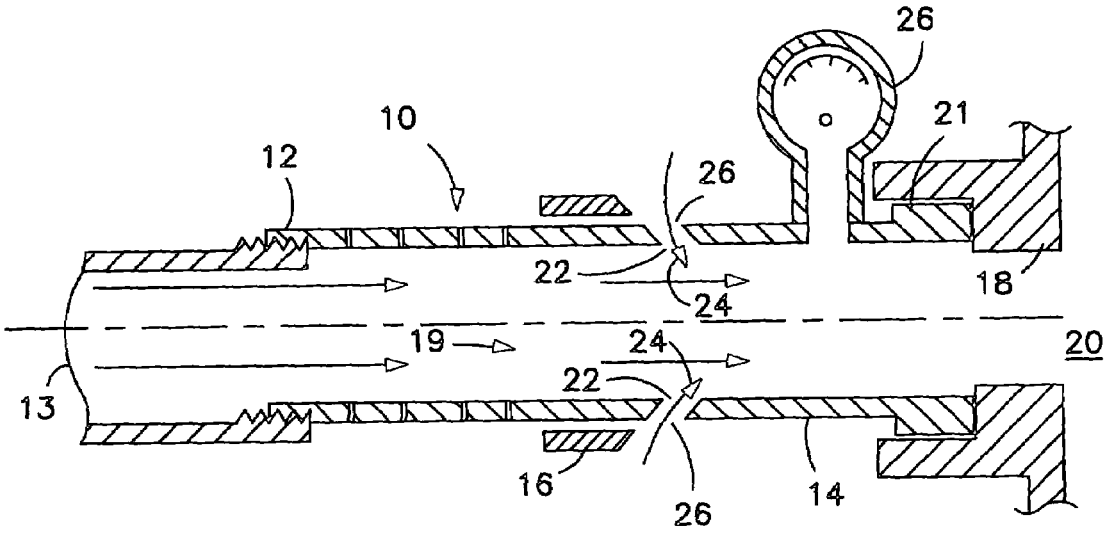
FIG. 2A is a sectional view of FIG. 1A.

Turning now to a description of a best mode, FIGS. 1A, B are assembly views of one embodiment of the invention and FIGS. 2A, B are sectional views of FIGS. 1A, B respectively.

There is shown a nozzle 10 connected at a threaded entry end 12 to a source 13 of pressurized air. The exit end 21 of the nozzle is shown inserted into an entrance 21 of an air bag 20.

The nozzle 10 comprises a barrel section 14 and a sleeve 16 that slides telescopingly onto the barrel 14.

A plurality of venturi openings 22 is provided in the side of the barrel 14. Each venturi opening 22 is a tunnel 22 from the interior surface of the barrel 14 to the outside surface of the barrel 14. Each tunnel 22 slants from the opening in the interior surface of the barrel 14 backward to the outside opening of the tunnel 22 toward the entrance end 12 of the barrel 14.

FIG. 2A shows one position of the sleeve 16 on the barrel 14 where the sleeve 16 does not cover the tunnels 22, as air 19 flows through the barrel 14. When the user inserts the exit end 16 of the nozzle 10 into the entrance 18 of the bag 20, pressurized air flows from the source 13, through the barrel 14 and into the bag 20. The flow of air through the barrel 14 "drags" additional air through the tunnels 22 by virtue of the "venturi" effect. The rate of flow through the barrel 14 into the bag 20 is increased appreciably. Bag 20 is cutaway in FIG. 2A.

Figure 2B:
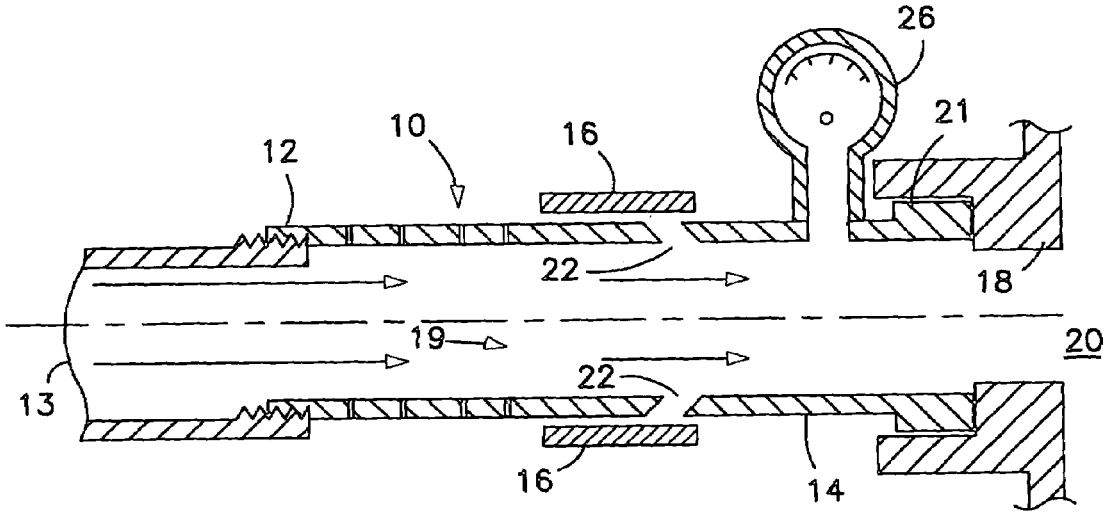
FIG. 2B is a sectional view of FIG. 2B.

FIG. 2B shows that when the pressure inside the bag increases to where air flow reverses direction and flows through the venturi tubes 22 out of the bag, then the sleeve 16 is slid forward to where flow through the venturi tunnels 22 is prevented. Air will continue to flow into the bag until a target pressure is reached as noted by a pressure gauge 26.

Figure 3A:
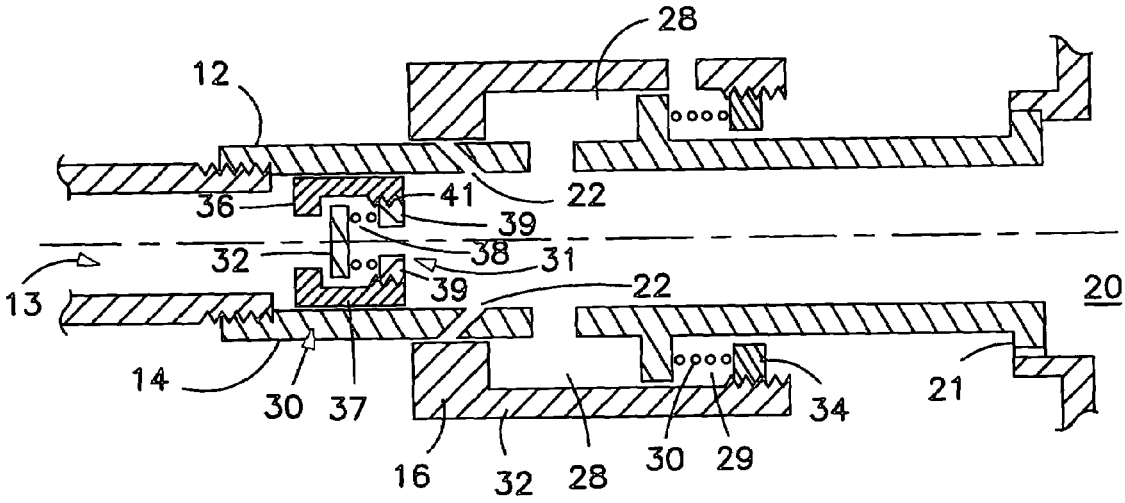
FIG. 3A is an automatic version of the wherein position of the sleeve is controlled by pressure in the bag. The sleeve is in the "fast flow" position.

FIGS. 3A, B show another version of the invention including a pressure chamber 28 and an expandable chamber 29 containing a spring 30. The pressure chamber 28 is bounded by a jacket 32 that is an extension of sleeve 16. A stop plate 34 is screwed into jacket 32.

A flange 38 is an integral part of barrel 14. One side of flange 38 forms one wall of the pressure chamber 28 and the opposite side of flange 38 forms a stop for one end of stop spring 30. The other end of valve spring 30 butts against stop plate 34. Compressible force of spring 30 is adjustable by turning the threaded stop plate 34.

Referring to FIG. 3A, when the nozzle 10 is first connected between the bag 20 and source 13, pressure in the bag 20 (and barrel 14) is at a minimum.

Pressure in the chamber 28 is also at a minimum so that the spring 30 is expanded and the pressure chamber 28 is minimum size. Sleeve 16 is retracted so that the tunnels 22 are open. Air flow from source 13 to bag 20 drags air through venturi tunnels 20 thereby greatly increasing flow of air into the bag.

Figure 3B:
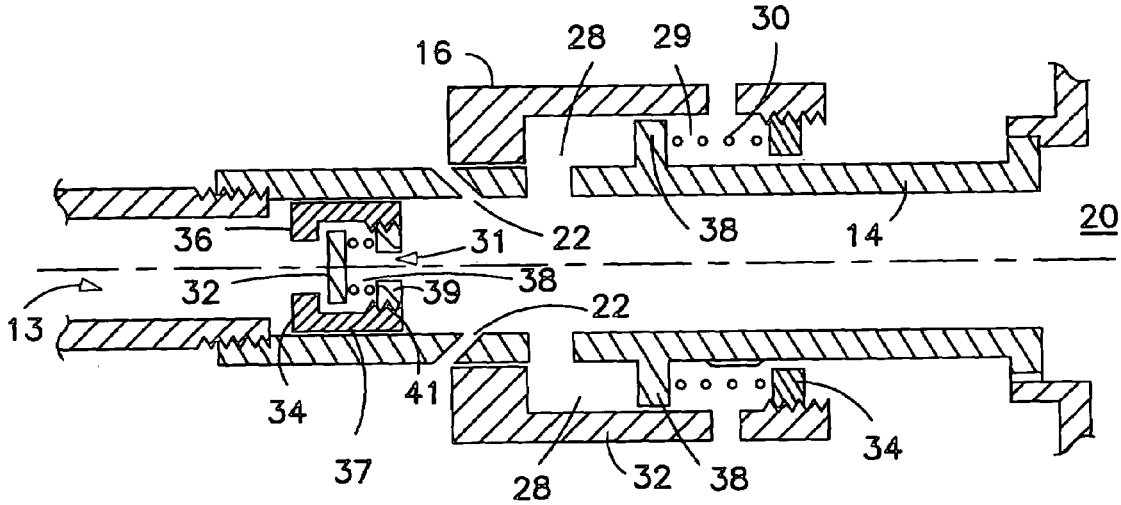
FIG. 3B is an automatic version of the wherein position of the sleeve is controlled by pressure in the bag. The sleeve is in the "high pressure" position.

FIG. 3B shows that, as the pressure in the bag and barrel 14 increases, pressure in the chamber 28 increases causing the chamber 28 to expand. Expansion of the chamber 28 causes the sleeve 16 to slide over (and close) the opening to the tunnels 22.

Air will therefore continue to flow into the bag until a target pressure is reached.

FIGS. 3A, B also show a spring actuated "stop" valve 31 that automatically shuts off flow when a target pressure in the bag is reached.

There is shown a tube 37 that fits snugly and is anchored to an inside surface of barrel 14. The tube 37 has an entry shoulder 36 on an entry end of the tube 37 and an internal thread 41 on an exit end of the tube 37. A stop ring 39 is screwed into the threaded end of tube 37. A moveable valve plate 32 is positioned adjacent entry shoulder 36. A compression spring 38 has one end abutting valve plate 32 and the other end abutting stop ring 39. The compression spring forces valve plate 32 toward entry shoulder 36. Spring force against the valve plate is adjustable by adjustment of the stop ring 39 in the threaded end 41 in tube 37.

When the air pressure is initially applied to the entrance end of the nozzle, the valve plate is forced away from entry shoulder 36 allowing gas to flow through the nozzle into the bag 20. When pressure in the bag reaches a value preset by positioning stop ring 30 to bias spring 38, then the increase pressure in the bag will force the valve plate against entry shoulder 36 and stop flow of gas through the nozzle.

The advantage of the automatic version of the nozzle 10 shown in FIGS. 3A, B is that where there are a large number of containers (bags) that must be inflated, an operator can attach more than one nozzle to a respective container so that several bags can be filling quickly and simultaneously and each nozzle will shut off automatically without supervision by the operator. Control of airflow through each nozzle is automatic.

Variations and modifications may be contemplated after reading the specification and studying the drawings that are within the scope of the invention.

For example, the nozzle may be applied to filling containers other than paper bags with a gas other than air.

For example, one application would be filling a large number of balloons with hydrogen.

It is therefore intended to define the scope of this invention by the appended claims.

What is claimed is:

1. A nozzle for filling a container with a gas from a pressurized source of gas, comprising:

a barrel having an entry end of said barrel adapted for communication with said pressurized source and an exit end adapted for communication with said container;

said barrel having plurality of tunnels extending from an exit opening at an interior surface of said barrel to an entrance opening at an exterior surface of said barrel said exit opening at said interior surface of said barrel being closer to said entry opening than said entrance opening at said exterior surface;

a sleeve adapted for telescopingly sliding on said barrel where, in a slow flow position of said sleeve, said sleeve on said barrel covers said tunnels preventing gas from flowing through said tunnels and in a non flow position of said sleeve on said barrel, said gas is able to flow through said tunnels;

a flange mounted integrally on said barrel;

a jacket having one end integrally mounted on said sleeve and another end telescoping onto said flange arranged to provide an expandable pressure chamber defined by an interior surface of said jacket, said flange, said exterior surface of said sleeve, and an end surface of said sleeve;

an opening in said barrel arrange to provide communication between said pressure chamber and an interior region of said barrel;

a compression spring having one end abutting a surface of said flange and another end of said spring abutting a member of said jacket;

said compression spring, being outside said compression chamber;

said compression spring, flange, barrel, sleeve, jacket all arranged in operable combination to provide that when gas pressure in said barrel increases, a size of said pressure chamber increases, said spring is compressed, and said sleeve is forced toward a position where said sleeve closes said tunnels and when said gas pressure in said barrel decreases, said sleeve is forced toward a position where said tunnels are open.

2. The nozzle of claim 1 wherein a position of said member is adjustable.

3. The nozzle of claim 2 further comprising a valve means inside said barrel for closing said valve when pressure in said barrel reaches a critical value.

4. The nozzle of claim 3 wherein said valve means comprises:

a pair of seat rings positioned concentrically inside said barrel;

one of said seat rings positioned closest to said exit end of said barrel;

a plate positioned concentrically between said set rings;

a compression spring having one end abutting one said seat ring closest to said entrance end of said nozzle and another end abutting said plate;

a tube fitting snugly and anchored to an inside surface of barrel , an entry shoulder on an entry end of the tube;

said tube having an internal thread on an exit end of said tube;

a stop ring screwed into the threaded end of tube;

a moveable valve plate adjacent said entry shoulder;

a compression spring having one end abutting a surface of said valve plate opposite said entry shoulder;

another end of said spring abutting said stop ring arrange to provide that said compression spring forces said valve plate toward said entry shoulder 36 with a spring force adjustable by adjusting position of the stop ring in the threaded end of tube and providing that when air pressure is initially applied to the entrance end of the nozzle, said valve plate is forced away from said entry shoulder allowing gas to flow through said nozzle into said container and when pressure in said container reaches a value preset by positioning stop ring, then said valve plate is forced against entry shoulder 36 and stops flow of gas through said nozzle.

* * * * *